US006095910A

United States Patent [19]

Luedeke

[11] Patent Number: 6,095,910

[45] Date of Patent: Aug. 1, 2000

[54] SURFACE TREATMENT ARTICLE HAVING A QUICK RELEASE FASTENER

[75] Inventor: Arthur P. Luedeke, Marine on St. Croix, Minn.

[73] Assignee: 3M Innovative Properties Company, St. Paul, Minn.

[21] Appl. No.: 08/966,644

[22] Filed: Nov. 10, 1997

[51] Int. Cl.[7] ..... B24B 23/00

[52] U.S. Cl. ..... 451/359; 451/490

[58] Field of Search ..... 451/359, 158, 451/259, 353, 548, 490; 411/508, 517

[56] References Cited

U.S. PATENT DOCUMENTS

| | | | |
|---|---|---|---|
| Re. 26,552 | 3/1969 | Block et al. . | |
| 1,587,843 | 6/1926 | Koreneff . | |
| 2,671,994 | 3/1954 | Hickman . | |
| 2,764,853 | 10/1956 | Rhees . | |
| 2,800,752 | 7/1957 | Short . | |
| 3,154,894 | 11/1964 | Dawkins . | |
| 3,157,010 | 11/1964 | Block . | |
| 3,210,892 | 10/1965 | Perham . | |
| 3,270,467 | 9/1966 | Block et al. . | |
| 3,315,420 | 4/1967 | Moberg | 51/378 |
| 3,362,114 | 1/1968 | Hurst . | |
| 3,376,675 | 4/1968 | Hutchins . | |
| 3,460,292 | 8/1969 | Ferchland . | |
| 3,526,065 | 9/1970 | Lee . | |
| 3,562,968 | 2/1971 | Johnson et al. . | |
| 3,579,917 | 5/1971 | Boettcher et al. . | |
| 3,603,042 | 9/1971 | Boettcher . | |
| 3,667,169 | 6/1972 | Mackay, Jr. | 51/379 |
| 3,688,453 | 9/1972 | Legacy et al. . | |
| 3,739,535 | 6/1973 | Fournier . | |
| 3,747,286 | 7/1973 | Haigh | 51/389 |
| 3,858,368 | 1/1975 | Cocherell et al. . | |
| 4,015,371 | 4/1977 | Grayston | 51/168 |
| 4,311,489 | 1/1982 | Kressner . | |
| 4,541,205 | 9/1985 | Patrello | 51/168 |
| 4,605,154 | 8/1986 | Herrmann et al. | 51/401 |
| 4,652,275 | 3/1987 | Bloecher et al. . | |
| 4,765,096 | 8/1988 | Lang . | |
| 4,799,939 | 1/1989 | Bloecher et al. . | |
| 4,932,163 | 6/1990 | Chilton et al. . | |
| 4,944,638 | 7/1990 | Brohammer . | |
| 5,088,241 | 2/1992 | Lubbering et al. . | |
| 5,152,631 | 10/1992 | Baur . | |
| 5,207,028 | 5/1993 | Timmons . | |
| 5,226,682 | 7/1993 | Marrison et al. | 285/308 |
| 5,309,682 | 5/1994 | Gutknecht et al. . | |
| 5,423,717 | 6/1995 | Boaz . | |
| 5,443,413 | 8/1995 | Pflager et al. . | |
| 5,443,906 | 8/1995 | Pihl et al. . | |
| 5,486,176 | 1/1996 | Udert et al. | 451/359 |
| 5,505,747 | 4/1996 | Chesley et al. . | |
| 5,531,635 | 7/1996 | Mogi et al. . | |
| 5,611,724 | 3/1997 | DeGraaff . | |
| 5,639,273 | 6/1997 | Sjolander et al. . | |
| 5,679,067 | 10/1997 | Johnson et al. . | |
| 5,727,821 | 3/1998 | Miller | 285/318 |
| 5,816,625 | 10/1998 | Clark | 285/305 |

FOREIGN PATENT DOCUMENTS

| | | |
|---|---|---|
| 0 397 624 A2 | 11/1990 | European Pat. Off. . |
| 0 397 624 A3 | 11/1990 | European Pat. Off. . |

OTHER PUBLICATIONS

Product Sheets (3 pages) "Blue–Point".¼", 3/8" and ½" Drive Air Ratchets; ¾", 1" and Spline Drive Air Impact Wrenches; and Power Tools ¼", 3/8" and ½" Drive Air Impact Wrenches.

Brochure, Bal Seal Catalog No. 3.1E, Canted Coil Springs (12 pages), by Bal Seal Engineering Company Inc., Santa Ana California.

*Primary Examiner*—Timothy V. Eley
*Assistant Examiner*—Dung Van Nguyen
*Attorney, Agent, or Firm*—James J. Trussell

[57] ABSTRACT

A surface treating article including a quick release fastener. The fastener includes a first end opposite the article, a second end adjacent the article, a tapered portion increasing in cross sectional area in the direction from the first end to the second end, a groove located between the tapered portion and the second end, and a mating portion having a non-circular cross section. Preferably, the mating portion has a hexagonal cross section. Also disclosed is a backup pad for use with the surface treating article. The backup pad includes an opening having a cross sectional area that corresponds to the cross-sectional area of the mating portion of the fastener. The backup pad also includes an o-ring in the opening to engage the groove in the fastener.

33 Claims, 3 Drawing Sheets

SURFACE TREATMENT ARTICLE HAVING A QUICK RELEASE FASTENER

TECHNICAL FIELD

The present invention relates generally to abrasive articles and more particularly to arrangements for mounting abrasive articles on a backup pad.

BACKGROUND OF THE INVENTION

U.S. Pat. No. 3,562,968 to Johnson et al. discloses a surface treating tool providing for easy installation of the surface treating article. The surface treating article has adhered thereto a drive button that engages a complementary cylindrical opening in a drive assembly comprising a backup pad which is driven by a driving means. The adhesively-bonded drive button provides for quick and easy attachment and removal of surface treating elements without special mounting tools. A similar fastening system incorporated in various embodiments of integrally molded brushes is disclosed in U.S. Pat. No. 5,679,067, "Molded Abrasive Brush," (Johnson et al); and WIPO International Patent Application No. WO96/33638, "Abrasive Brush and Filaments," (Johnson et al.).

Surface conditioning discs having a threaded male button bonded to the back side of the disc by an adhesive are available commercially as Roloc™ surface conditioning discs from Minnesota Mining and Manufacturing Company, St. Paul, Minn. Coated abrasive discs including a threaded male button bonded to the back are also available. These surface conditioning discs have on the front side a conformable, three-dimensional non-woven open web material formed of synthetic fibers and abrasive particles. This web is needle tacked to an open weave scrim backing. U.S. Pat. No. 3,688,453 to Legacy et al. describes abrasive articles which comprise a lofty non-woven web needle tacked to a woven backing and impregnated with resin and abrasive.

Although the commercial success of the attachment system of Roloc™ abrasive articles has been impressive, it is desirable to further improve the attachment system.

SUMMARY OF THE INVENTION

One aspect of the present invention provides a surface treating article. The surface treating article comprises a surface treating element with a fastener on the rear surface thereof. The surface treating element includes a generally planer backing that includes a working surface and a rear surface, in which the working surface has desired characteristics for refining a surface. The fastener includes: i) a first end opposite the backing; ii) a second end adjacent the backing; iii) a tapered portion that increases in cross sectional area in the direction from the first end to the second end; iv) a groove located between the tapered portion and the second end; and a mating portion having a non-circular cross section.

The mating portion of the fastener may have a cross section that is a polygon, a regular polygonal, a hexagonal cross section, or any other non-circular cross section.

The surface treating element may be a molded brush including a plurality of bristles extending from the backing. In this case, the fastener may be integrally molded with the molded brush. The surface treating element may be a coated abrasive article having the fastener joined thereto. The surface treating element may be a non-woven surface conditioning article having the fastener joined thereto.

Another aspect of the present invention provides a quick release system for releasably attaching a surface treating article to a backup pad. The system includes a surface treating article with a fastener as described above, and a back-up pad. The back up pad includes a body with a front surface and a back surface, a mounting opening provided on the front surface. The opening is formed by an inner surface generally perpendicular to the body and defining a non-circular cross section corresponding to the mating portion cross section. The opening includes an elastic means mounted therein for releasably engaging the groove in the fastener.

The present invention also provides a fastener for use with a rotary surface treating element. The fastener comprises a base and a fastener member. The base includes a front surface and a rear surface, and a fastener member extending from the rear surface. The fastener member includes a first end opposite the base backing, a second end adjacent the base, a tapered portion that increases in cross sectional area in the direction from the first end to the second end, a groove located between the tapered portion and the second end, and a mating portion having a non-circular cross section.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention is directed to surface treatment articles which include a quick release fastener on the rear surface thereof The fastener can be integral and unitary with the surface treating articles, such as when the article is a molded brush and the fastener is molded therewith. Alternatively, the fastener can be a separate element that is joined to the surface treating element. Such embodiments include coated abrasive discs and nonwoven surface conditioning discs having the fastener mounted on the rear surface thereof. Molded brushes may also have the fastener formed separately and then joined thereto.

Figure 1:
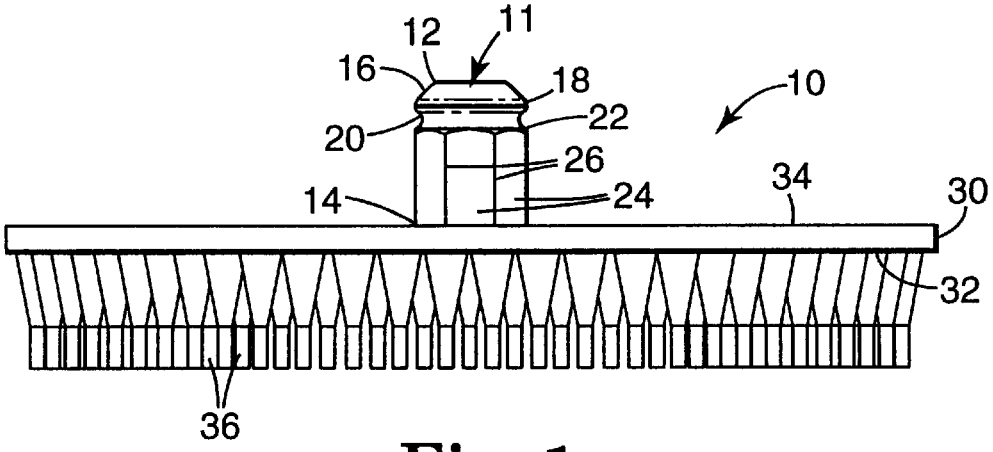
FIG. 1 is a side elevational view of a first embodiment of a surface treating article including a quick release fastener.
Figure 2:
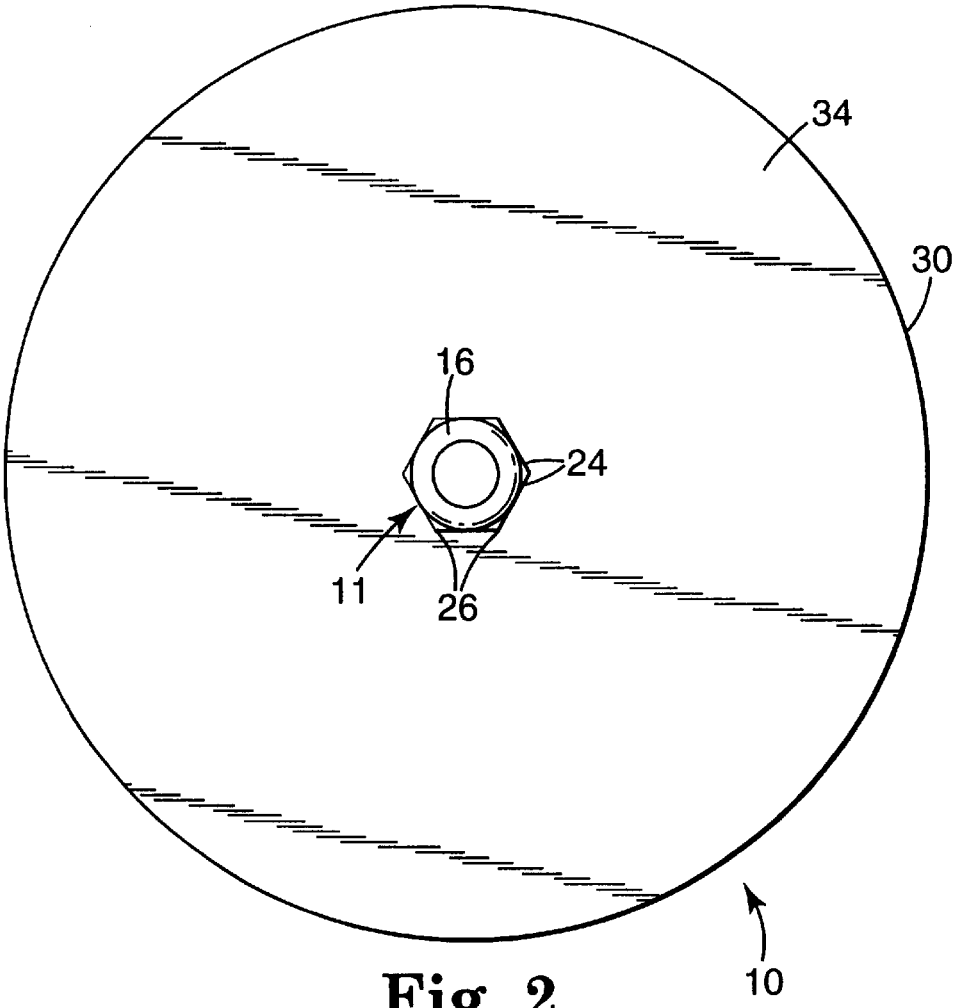
FIG. 2 is a top plan view of the article of FIG. 1.

Referring to FIGS. 1 and 2, surface treatment article 10 in this embodiment is a molded brush. Brush 10 comprises a backing 30 having front surface 32 and rear surface 34. A plurality of bristles 36 project outwardly from front surface 32 of backing 30. In between bristles 36 there are spaces in which the front surface 32 of the backing is exposed. In one embodiment, the brush is preferably integrally molded and comprises a moldable polymer substantially free of abrasive particles. In another embodiment, the brush is preferably integrally molded and comprises a generally homogenous composition of abrasive particles in a moldable polymer. In another embodiment, abrasive particles may be homogeneously dispersed within bristles 36 but not it backing 30.

Surface treatment article 10 comprises fastener 11 integral with backing 30. The fastener provides a means to secure the surface treatment article 10 to a rotary tool and/or a support pad or a backup pad during use. It is preferred that the fastener 11 is molded integrally with the backing and bristles. It is preferred that the fastener 11 be centered relative to the backing for proper rotation. The fastener is adapted to attach the surface treatment article to a high speed rotary tool, such as a right angle grinder, for example. Such an arrangement allows the surface treatment article to be rotated at high speeds about an axis of rotation centered on the attaching means, and generally perpendicular to the backing (for flat, planar bases). In such an embodiment, each of the bristles is translated in a circular path about the axis of rotation, while being oriented generally parallel to the axis of rotation. Preferably, the brush and fastener are configured to be capable of being rotated at least 100 RPM, depending on the size and configuration, preferably at least 5000 RPM, and some smaller brushes are capable of being rotated at up to 30,000 RPM. The fastener 11 may be made from the same material as the rest of the brush 10, and may contain the optional abrasive particles. Alternatively, the fastener 11 may be made from a separate injection of moldable polymer without abrasive particles.

The fastener 11 includes a first end 12 which is configured to fit into a corresponding opening in the backup pad or drive shaft as described below. Fastener 11 also includes second end 14 adjacent the backing of the surface treatment article. Adjacent first end 12 is a tapered portion 16 to facilitate engagement of the fastener 11 into the opening of the backup pad and to facilitate engagement with the o-ring described below. Adjacent to and rearward from the taper 16 is a flat portion 18 which defines the bottom end of groove 20. Rearward of groove 20 is a taper 22 which transitions into flat walls 24 and corners 26. The walls 24 and comers 26 are configured for close fit with the walls and comers of the opening in a backup pad. The walls 24 thus define a mating portion with a cross section corresponding to the cross section of the opening in the backup pad. The groove 20 is configured for a snap engagement with the o-ring 80 in the backup pad 50. Rearward of the flat walls 24 is the rear surface 34 of the backing 30 on the molded brush.

Figure 3:
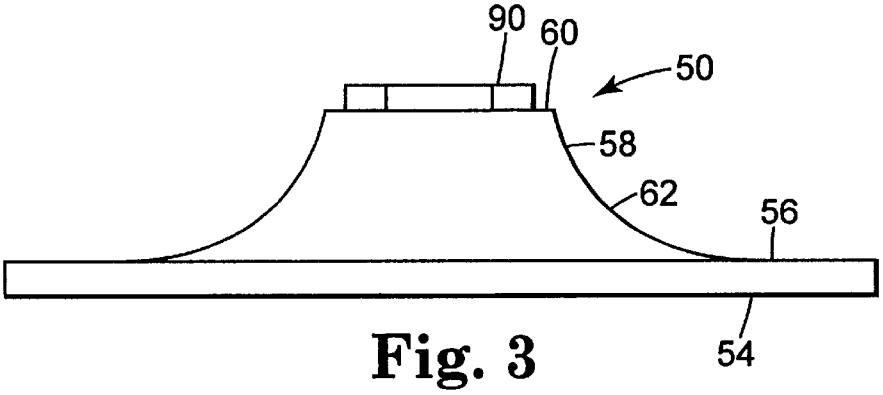
FIG. 3 is a side elevational view of a backup pad for use with the surface treating article of the present invention.
Figure 4:
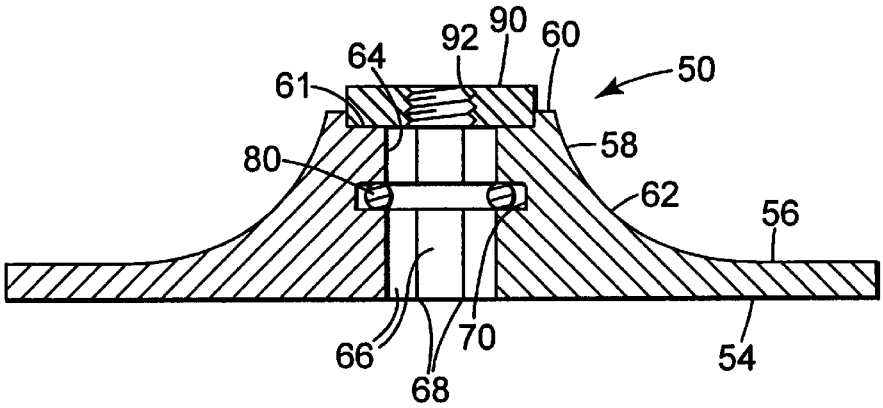
FIG. 4 is a cross sectional view of the backup pad of FIG. 3.

FIG. 3 illustrates a side view of a backup pad 50 for use with the surface treating articles described herein. Backup pad 50 includes front surface 54 for supporting the surface treating article and rear surface 56 which tapers to boss 58. The boss 58 includes a first end 60 having a recess 61 therein. Mounted in recess 61 is a mounting nut 90 having a threaded inner diameter 92 for engagement with the drive shaft on a power tool. The backup could instead include a quick change arrangement for attachment to a power tool such as described in United States Patent Application Ser. No. 08/966,643, "Backup Pad for Abrasive Articles, and Method of Use," Luedeke, attorney docket number 53728USA9A, filed on even date herewith. As seen in FIG. 4, backup pad 50 includes an opening 64 in the front surface 54 for receiving the fastener 11 on the surface treating article. In the preferred illustrated embodiment, the opening 64 includes flat walls 66 which join at corners 68. In the preferred embodiment, the walls define a hexagonal cross-sectional opening 64. The opening also includes a groove 70 in which is retained an o-ring 80. Depending on the material of the backup pad, the groove 70 is may molded into the opening 64 or machined into the opening 64.

Figure 5:
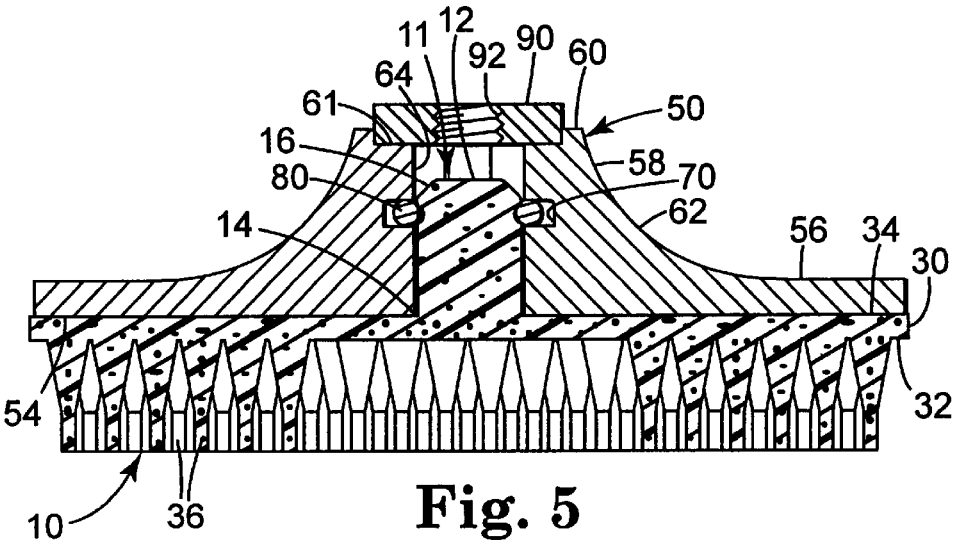
FIG. 5 is a cross sectional view of the surface treating article of FIG. 1 mounted in the backup pad of FIG. 4.

FIG. 5 illustrates the fastener 11 of the surface treating article 10 mounted onto the backup pad 50. The fastener 11 and opening 64 in the backup pad 50 are configured for close engagement with one another to minimize relative rotation between the backup pad and the surface treating article. The backup pad is preferably somewhat smaller in diameter than the surface treating article. However, the backup pad can be significantly smaller than the surface treating article, or can be larger than the surface treating article. The material and size of fastener 11 and the backup pad 50 at the opening 64 are selected to withstand the torque imparted during use of the backup pad 10 with a power tool. Preferred materials for the fastener 11 include those preferred materials for molded brush 10 described below, and those materials described below for fastener 11 discussed with respect to FIGS. 6 and 7. Preferred materials for backup pad 50 include metal, nylon, hard rubber, and composites.

Groove 20 in fastener 11 engages with o-ring 80 to prevent inadvertent release of the surface treating article 10 from the backup pad 50, while allowing the surface treating article to be easily removed from the backup pad without tools simply by pulling the article 10 away from the backup pad 50 with enough force to overcome the snap fit between the o-ring 80 and groove 20. It is seen that the distance between the rear surface 34 of backing 30 and groove 20 on the fastener 11 can be chosen such that front surface 54 of the backup pad 50 engages with the shoulder rear surface 34 of the backing 30 when groove 20 is engaged with the o-ring 80. It is also seen that taper 16 on the fastener 11 facilitates engagement of the fastener with the o-ring, and expands the o-ring as the fastener 11 is inserted into the opening 64 in the backup pad 50. The elastic and resilient o-ring 80 then snaps back to a small diameter and engages with the groove 20 in the fastener 11. O-ring 80 may instead by any type of elastic member that releasably engages with groove 20 in fastener 11. Suitable elastic members include split rings, C-clips, and the like. These can be made of any suitable material such metal, rubber, vinyl, or composites selected to allow the elastic member to expand elastically without significant permanent deformation, and then contract into the groove in the fastener.

The dimensions of the walls 24 on the fastener 11 relative to the opening 64 in the backup pad 50 should be selected to minimize relative rotation between the surface treating article and the backup pad during use, while allowing easy mounting and dismounting of the surface treating article from the backup pad. Arrangements for the cross-sectional shape of the mating portion of the fastener 11 and opening 64 other than hexagonal may be chosen. Preferred arrangements include any polygonal cross-sectional shapes. For example 3, 4, or 7 or more walls may be used on the mounting portion of the fastener 11 and in the opening 64 in the backup pad 50. Preferably, a regular polygon is used, that is all walls are the same size, to reduce the need to index the surface treatment article at any particular angular orientation relative to the backup pad. However, a non-regular or non-symmetrical arrangement may be used if desired. Furthermore, any non-polygonal arrangement may be used for the cross-sectional shape of the mating portion of the fastener 11 and the shaft and opening 64 in the backup pad, except for circular, to provide an arrangement in which the surface treating article does not rotate relative to the backup pad. Therefore, what is required is that the opening 64 and the corresponding portion of the fastener 11 be non-cylindrical, thereby providing a fit to prevent relative rotation between the surface treating article and the backup pad.

Optionally, the mating portion may be tapered so as to be larger at second end 14 adjacent the surface treating article and smaller at the end adjacent groove 20. The opening 64 in the backup pad could be tapered so as to be larger at the first surface 54 of the backup pad. With such an arrangement, the fastener 11 would be forced deeper into the opening 64 during use, such that the taper causes the mating portion to fit more snugly within opening 64, and to provide self centering of the fastener 11 relative to the backup pad.

Alternative arrangements are also within the scope of the present invention. For example, although the o-ring 80 is illustrated as remaining in the groove 70 in opening 64 in the backup pad 50, the o-ring 80 may instead remain in the groove 20 on the fastener 11. Furthermore, the components of the mounting system may be reversed. That is, a fastener 11 may be included on the power tool backup pad for engagement with a mating opening in the surface treating article.

Referring back to the molded brush embodiment of the surface treating article 10 illustrated in FIGS. 1 and 2, in a preferred embodiment the backing 30 is generally planar. However, it is within the scope of the invention to have a contoured or curved backing. For example, the backing may be convex, concave, or conical in shape. In such an arrangement, the bristles may be of uniform length in which case the tips of the bristles will not be coplanar, or bristles may be of varying length in which case the tips may be coplanar. The backing may be flexible or rigid, and may include a reinforcing member to increase its rigidity. The backing can preferably have a thickness of from about 1.0 to 15.0 mm, more preferably from about 1.5 to 10 mm, still more preferably from about 2.0 to 6 mm, and most preferably from about 2.5 to 4.0 mm. Backing 30 is preferably circular as illustrated in FIG. 2. The diameter of backing is preferably from about 2.5 to 20.0 cm (1.0 to 8.0 in), although smaller and larger backings may be used. Backing shapes other than circular may be used, including, but not limited to, oval, rectangular, square, triangular, diamond, and other polygonal shapes.

Preferably, the backing is molded integral with the bristles to provide a unitary brush. Thus, no adhesive or mechanical means is required to adhere the bristles to the backing. It is preferred that the backing and bristles are molded simultaneously. In some instances, there may be a single mixture of abrasive particles and moldable polymer that is placed in the mold in a single injection process. In such an embodiment, the brush 10 comprises a generally homogenous composition throughout. However, due to the molding process, the abrasive particle/binder mix may not be perfectly homogeneous. Alternatively, there may be two or more insertions of a moldable polymer to the mold. For example, one insertion may contain a mixture of moldable polymer and optional abrasive particles primarily located in the bristles. A second insertion, which would be present primarily in the backing 30 of the brush 10, may contain moldable polymer without abrasive particles or with fewer abrasive particles.

The bristles 36 extend from the front surface 32 of backing 30. The bristles may have any cross sectional area, including but not limited to, circular, star, half moon, quarter moon, oval, rectangular, square, triangular, diamond or polygonal. In one preferred embodiment, the bristles comprise a constant circular cross section along the length of the bristle. In other preferred embodiments, the bristles have a non-constant or variable cross section along all or a portion of the length of the bristle.

It is preferred to have tapered bristles such that the cross sectional area of the bristle decreases in the direction away from backing 30. Tapered bristles can have any cross section as described above, and preferably have a circular cross section. Tapered bristles tend to be easier to remove from the mold during fabrication of the brush than constant cross sectional area bristles. Furthermore, bristles are subjected to bending stresses as brush 10 is rotated against a workpiece. These bending stresses are highest at the root of the bristles. Therefore, a tapered bristle such as illustrated in FIG. 1 is more able to resist bending stresses than a cylindrical bristle. Furthermore, the bristles preferably include a fillet radius at the transition between the root of the bristle and the front surface 32 of the backing.

Bristles 36 comprise an aspect ratio defined as the length of the bristle measured from root to tip, divided by the width of the bristle. In the case of a tapered bristle, the width is defined as the average width along the length for purposes of determining the aspect ratio. In the case of a non-circular cross section, the width is taken as the longest width in a given plane, such as the corner-to-corner diagonal of a square cross section. The aspect ratio of bristles 36 is preferably at least 1, more preferably from about 4 to 18, and still more preferably from about 6 to 16. The size of bristles can be selected for the particular application of brush 10. The length of the bristles is preferably from about 5 to 80 mm, more preferably from about 5 to 50 mm, still more preferably from about 5 to 25 mm, and most preferably from about 10 to 20 mm. The width of the bristles is preferably from about 0.25 to 10 mm, more preferably from about 0.5 to 5.0 mm, still more preferably about 0.75 to 3.0 mm, and most preferably from about 1.0 to 2.0 mm. In one preferred embodiment, all of the bristles have the same dimensions. Alternatively, bristles on a single brush may have different dimensions such as different lengths, widths or cross sectional areas. The lengths of the bristles and contour of the backing are preferably chosen so that the tips are generally coplanar, although other arrangements are also within the present invention. The density and arrangement of the bristles 18 can be chosen for the particular application of brush 10. The bristles 18 may be arranged on the base 12 in a random or ordered pattern. Preferably, the bristles are perpendicular to planar backing 30. This makes it easier to remove the molded brush 10 from the mold. However, it is also within the scope of the present invention for the bristles to be oblique to the backing.

The moldable polymer material is preferably an organic binder material that is capable of being molded, i.e., it is capable of deforming under heat to form a desired shape. The moldable polymer may be a thermoplastic polymer, a thermosetting polymer, or a thermoplastic elastomer. In the case of a thermoplastic polymer, the organic binder is heated above its melting point which causes the polymer to flow. This results in the thermoplastic polymer flowing into the cavities of the mold to form the brush 10. The brush is then cooled to solidify the thermoplastic binder.

Examples of suitable thermoplastic polymers include polycarbonate, polyetherimide, polyester, polyethylene, polysulfone, polystyrene, polybutylene, acrylonitrile-butadiene-styrene block copolymer, polypropylene, acetal polymers, polyurethanes, polyamides, and combinations thereof. In general, preferred thermoplastic polymers of the invention are those having a high melting temperature and good heat resistance properties. Thermoplastic polymers may be preferably employed for low speed applications of brush 10, in which stress during operation is relatively low. Examples of commercially available thermoplastic polymers suitable for use with the present invention include Grilon™ CR9 copolymer of Nylon 6,12 available from EMS-American Grilon, Inc., Sumter S.C.; Profax™ and KS075 polypropylene based thermoplastic available from Himont USA, Inc., Wilmington, Del.; and Duraflex™ polybutylene based thermoplastic available from Shell Chemical Co., Houston, Tex.

In some instances, such as high speed, high stress applications, it is preferred that the moldable polymer is a thermoplastic elastomer ("TPE") or includes a thermoplastic elastomer. Commercially available thermoplastic elastomers include segmented polyester thermoplastic elastomers, segmented polyurethane thermoplastic elastomers, segmented polyamide thermoplastic elastomers, blends of thermoplastic elastomers and thermoplastic polymers, and ionomeric thermoplastic elastomers. Segmented thermoplastic elastomers useful in the present invention include polyester TPEs, polyurethane TPEs, and polyamide TPEs, and silicone elastomer/polyimide block copolymeric TPEs, with the low and high equivalent weight polyfunctional monomers selected appropriately to produce the respective TPE. "Thermoplastic polymer", or "TP" as used herein, has a more limiting definition than the general definition, which is "a material which softens and flows upon application of pressure and heat." It will of course be realized that TPEs meet the general definition of TP, since TPEs will also flow upon application of pressure and heat. It is thus necessary to be more specific in the definition of "thermoplastic" for the purposes of this invention. "Thermoplastic", as used herein, means a material which flows upon application of pressure and heat, but which does not possess the elastic properties of an elastomer when below its melting temperature. Blends of TPE and TP materials are also within the invention, allowing even greater flexibility in tailoring mechanical properties of the filaments of the invention.

Commercially available and preferred segmented polyesters include those known under the trade designations "Hytrel™ 4056", "Hytrel™ 5526", "Hytrel™ 5556", "Hytrel™ 6356", "Hytrel™ 7246", and "Hytrel™ 8238" available from E.I. Du Pont de Nemours and Company, Inc., Wilmington, Del., with the most preferred including Hytrel™ 5526, Hytrel™ 5556, and Hytrel™ 6356. A similar family of thermoplastic polyesters is available under the tradename "Riteflex" (Hoechst Celanese Corporation). Still further useful polyester TPEs are those known under the trade designations "Ecdel", from Eastman Chemical Products, Inc., Kingsport, Tenn.; "Lomad", from General Electric Company, Pittsfield, Mass,; "Arnitel" from DSM Engineered Plastics; and "Bexloy" from Du Pont. Further useful polyester TPEs include those available as "Lubricomp" from LNP Engineering Plastics, Exton, Pa., and is commercially available incorporating lubricant, glass fiber reinforcement, and carbon fiber reinforcement.

Commercially available and preferred segmented polyamides include those known under the trade designation "Pebax" and "Rilsan", both available from Atochem Inc., Glen Rock, N.J.

Commercially available and preferred segmented polyurethanes include those known under the trade designation "Estane", available from B.F. Goodrich, Cleveland, Ohio. Other segmented preferred segmented polyurethanes include those known under the trade designations "Pellethane", and "Isoplast" from The Dow Corning Company, Midland, Mich., and those known under the trade designation "Morthane", from Morton Chemical Division, Morton Thiokol, Inc.; and those known under the trade designation "Elastollan", from BASF Corporation, Wyandotte, Mich.

Thermoplastic elastomers are further described in U.S. Pat. No. 5,443,906 (Pihl et al.), the entire disclosure of which is incorporated herein by reference.

In embodiments which include the optional abrasive particles, the abrasive particles typically have a particle size ranging from about 0.1 to 1500 micrometers, usually between about 1 to 1000 micrometers, and preferably between 50 and 500 micrometers. The optional abrasive particles may be organic or inorganic.

Examples of abrasive particles include fused aluminum oxide, ceramic aluminum oxide, heated treated aluminum oxide, silicon carbide, titanium diboride, alumina zirconia, diamond, boron carbide, ceria, aluminum silicates, cubic boron nitride, garnet, and silica. Still other examples of abrasive particles include solid glass spheres, hollow glass spheres, calcium carbonate, polymeric bubbles, silicates, aluminum trihydrate, and mullite. As used herein, the term abrasive particles also encompasses single abrasive particles which are bonded together to form an abrasive agglomerate. Abrasive agglomerates are further described in U.S. Pat. Nos. 4,311,489; 4,652,275; and 4,799,939. The abrasive particles may also contain a surface coating. Surface coatings are known to improve the adhesion between the abrasive particle and the binder in the abrasive article.

Organic abrasive particles suitable for use with the brush of the present invention are preferably formed from a thermoplastic polymer and/or a thermosetting polymer. Organic particles can also be made from natural organic materials such as walnut shells, wheat starch, and the like. Organic abrasive particles useful in the present invention may be individual particles or agglomerates of individual particles. The agglomerates may comprise a plurality of the organic abrasive particles bonded together by a binder to form a shaped mass.

When organic abrasive particles are used in the molded brush of the present invention, the particles are preferably present in the moldable polymer at a weight percent (per total weight of moldable polymer and organic abrasive particles) ranging from about 0.1 to about 80 weight percent, more preferably from about 3 to about 60 weight percent. The weight percentage depends in part on the particular abrading or brush applications.

The organic abrasive particles can be formed from a thermoplastic material such as polycarbonate, polyetherimide, polyester, polyvinyl chloride, methacrylate, methylmethacrylate, polyethylene, polysulfone, polystyrene, acrylonitrile-butadienestyrene block copolymer, polypropylene, acetal polymers, polyurethanes, polyamide, and combinations thereof In general, preferred thermoplastic polymers of the invention are those having a high melting temperature, e.g. greater than 200° C., more preferably 300° C.; or good heat resistance properties. The organic abrasive particles should have a higher melting or softening point that the thermoplastic matrix, so that the organic particles are not substantially affected by the filament manufacturing process. The organic particle should be capable of maintaining a generally particulate state during filament or brush segment processing, and therefore should be selected so as not to substantially melt or soften during the filament manufacturing process.

A preferred organic abrasive particle is a metal and mold cleaning plastic blast media available commercially as "MC" blast media from Maxi Blast Inc., South Bend, Indiana, available with an antistatic coating, but preferably untreated. The "MC" media is a 99% melamine formaldehyde cellulosate, an amino thermoset plastic.

The average Knoop hardness ("KNH") of the organic abrasive particle is generally less than about 80 KNH, and preferably less than about 65 KNH.

It is also within the scope of this invention to incorporate inorganic based abrasive particles along with the organic abrasive particles.

When present, the optional abrasive particles are preferably from about 5 to 60 percent by weight of the particle and polymer mixture, and more preferably about 30 to 40 percent, although more or less may be used as desired.

The moldable polymeric material may further include optional additives, such as, for example, fillers (including grinding aids), fibers, antistatic agents, antioxidants, processing aids, UV stabilizers, flame retardants, lubricants, wetting agents, surfactants, pigments, dyes, coupling agents, plasticizers and suspending agents. The amounts of these materials are selected to provide the properties desired.

For some refining applications, it is preferred that the molded polymer include a lubricant. The presence of a lubricant in the moldable polymer reduces the friction of the bristle contacting the workpiece surface. This reduces the heat generated when refining the workpiece. Excessive heat may cause the brush to leave residue on the workpiece or to otherwise harm the workpiece. Suitable lubricants include lithium stearate, zinc stearate, calcium stearate, aluminum stearate, ethylene bis stearamide, graphite, molybdenum disulfide, polytetraflouroethylene (PTFE), and silicone compounds, for example useful with thermoplastics and thermoplastic elastomers.

An example of a preferred silicone material is a high molecular weight polysiloxane described in WIPO International Patent Application Publication No. WO96/33841; entitled "Abrasive Article Having a Bond System Comprising a Polysiloxane" (Barber), the description of the silicone material being incorporated Polysiloxanes are available in many different forms, e.g., as the compound itself or as a concentrate. Example of the polymers into which the polysiloxane can be compounded include polypropylene, polyethylene, polystyrene, polyamides, polyacetal, acrylonitrile-butadiene-styrene (ABS), and polyester elastomer, all of which are commercially available. Silicone modified Hytrel™ is available commercially as BY27-010 (or MB50-010), and silicone modified Nylon 6,6 is available as BY27-005 (or MB50-005), both from Dow Corning Company, Midland, Mich. Typically, commercially available concentrates may contain a polysiloxane at a weight percent ranging from 40 to 50; however, any weight percent is acceptable for purposes of the invention as long as the desired weight percent in the final product can be achieved. Lubricants preferably can be present in the moldable polymer in amounts of up to about 20 percent by weight (exclusive of abrasive particle content), and preferably in an amount from about 1 to 10 percent, although more or less may be used as desired.

The moldable polymeric material may include any or all of the following as is well known in the art: coupling agents; fillers; and grinding aids.

The brush 10 and fastener 11 of the present invention are preferably injection molded as is well known in the art. The mold will contain cavities which are the inverse of the desired brush and fastener configuration. Thus the mold design must take into account the brush configuration including the size and configuration of the backing 30, the bristles 36, and the fastener 11.

Further details on preferred molded articles and methods of making are disclosed in U.S. Pat. No. 5,679,067, "Molded Abrasive Brush," (Johnson et al); and WIPO International Patent Application No. WO96/33638, "Abrasive Brush and Filaments," (Johnson et al.), the entire disclosures of both of which are incorporated herein by reference.

Figure 6:
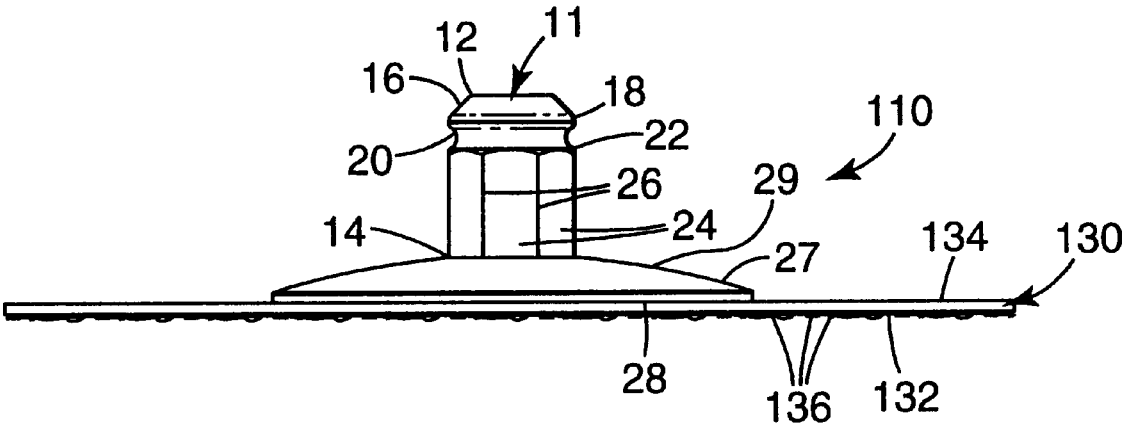
FIG. 6 is a side view of an alternate embodiment of a surface treating article.
Figure 7:
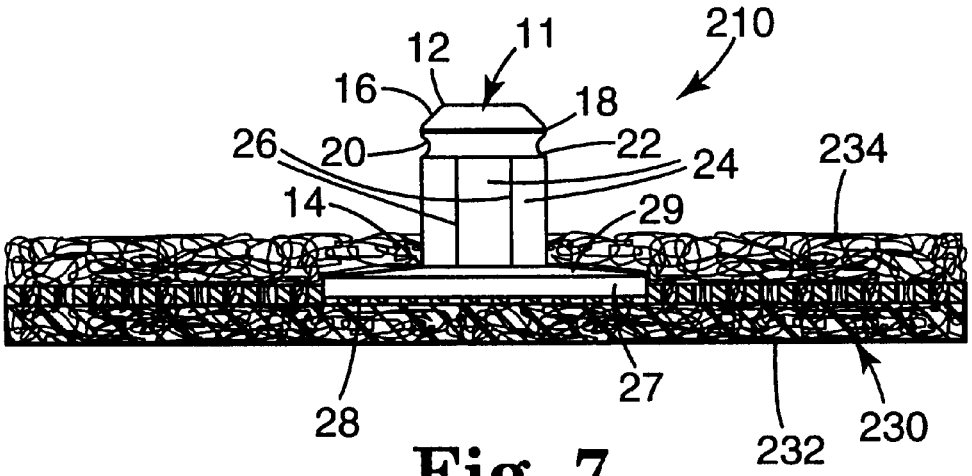
FIG. 7 is a side view of yet another alternate embodiment of a surface treating article.

It is also possible for the surface treating article of the present invention to be a coated abrasive disc, a nonwoven abrasive surface conditioning disc, a polishing pad, a brush, or similar surface treating element. The fastener 11 can be joined to such a surface treating article by any suitable means, such as by adhesive. One such embodiment is illustrated in FIG. 6 as surface treating article 110 comprising fastener 11 mounted on coated abrasive disc 130. Another embodiment is illustrated in FIG. 7 as surface treating article 210 comprising fastener 11 mounted on nonwoven surface conditioning disc 230. Surface treating elements 130, 230 have a working front surface 132, 232 and rear surface 134, 234. The fastener 11 is attached centrally to the rear surface of the article. Such a separate fastener 11 may also be joined to the molded brushes describe herein, rather than being integrally molded with the brush.

In any of the embodiment in which the fastener 11 is a separate element, a preferred embodiment of fastener 11 is as follows. As seen in FIGS. 6 and 7, fastener 11 includes a generally planar base 27. The base 27 includes a front surface 28 that is joined to the coated abrasive disc 130 or surface conditioning disc 230. The front surface 28 of the fastener base is preferably smooth and planar so as to provide sufficient surface area to achieve the desired strength of attachment to the surface treating article. It is also preferred that the base 27 of the fastener 11 is circular, although other shapes may be used. In one preferred embodiment, the base 27 of the fastener 11 has a diameter of approximately 3 cm (1.2 in), although larger and smaller fasteners are within the scope of the invention. Opposite to the front surface 28 of the base 27 is rear surface 29. As illustrated, rear surface 29 tapers toward the outer edge of the fastener base 27. Extending from the center of the rear surface 29 is the male element of the fastening system as described above with respect to the embodiment illustrated in FIGS. 1–2.

The fastener 11 may comprise any polymeric material that has the appropriate melt, flow, and adhesion characteristics to become attached to the surface treating article. Typically, useful polymeric materials will be thermoplastic in nature. Additionally, thermosetting polymeric materials may be employed if they are only lightly crosslinked or have a stable intermediate or "B-stage" state and therefore can be caused to flow under heat and pressure. Examples of such thermoplastic polymeric materials include polyamides, polyesters, copolyamides, copolyesters, polyimides, polysulfone, and polyolefins. An example of a suitable thermosetting polymeric material is a novolak molding powder. Of these, thermoplastics are preferred, and of the thermoplastics, polyamides are preferred, with poly(hexamethylene adipamide) (nylon 6,6) being most preferred. The polymeric material may optionally include colorants, fillers, process aids, and reinforcing agents. Examples of colorants include pigments and dyes. Examples of fillers include glass bubbles or spheres, particulate calcium carbonate, mica, and the like. Processing aids may be materials such as lithium stearate, zinc stearate, and fluoropolymer materials that are known to enhance the flow characteristics of molten polymeric materials. Reinforcing agents may include glass fiber, carbon fiber, and metal fiber, all at levels up to about 50% by weight. If reinforcement agent is used, the preferred filler content is 30 to 45% by weight glass fiber. The fastener 11 may be made by any process known to one skilled in the art. These include but are not limited to injection molding, reaction injection molding, and conventional machining. Preferred is injection molding.

One preferred embodiment of a surface treating article with a separate fastener 11 mounted thereon is the surface treating article 110 illustrated in FIG. 6. The surface treatment element is a coated abrasive disc 130, having a front or working surface 132, and rear surface 134. The fastener 11 is mounted on the center of the rear surface 134 such as by an adhesive. Suitable examples of coated abrasive discs 130 include any known abrasive article, such as conventional coated abrasive articles, including those available under the tradenames Regal™, Regalloy™, Regalite™, Green Corps™, and Trizac™ all available from Minnesota Mining and Manufacturing Company, St. Paul, Minn.

Another preferred embodiment of a surface treating article 210 of the present invention is illustrated in FIG. 7. The surface treating article 210 includes surface conditioning disc 230 having fastener 11 attached thereto. The fastener 11 is joined to the rear surface 234 of the surface conditioning disc 230.

One preferred surface treating article is a nonwoven abrasive surface conditioning disc 230, such as is commercially available from Minnesota Mining and Manufacturing Company, St. Paul, Minn., under the trade designation "SCOTCH-BRITE" A-CRS Surface Conditioning Disc; A-Med Surface Conditioning Disc or A-VFN Surface Conditioning Disc. The front or working surface 232 of such discs preferably comprises a lofty nonwoven web of nylon 6,6 staple fibers that has been needle punched through a reinforcing woven nylon scrim backing. Preferably, about 40% of the staple fibers of the web protrude through interstices formed by the warp yarns and fill yarns of the woven scrim to attach the nonwoven web and the woven scrim together. The remaining fibers remain on the front surface side of the surface conditioning disc 230. In addition, there are coatings of hard, thermosetting resins and abrasive particles on the lofty nonwoven web. A preferred surface conditioning article is described in detail in U.S. Pat. No. 3,688,453, "Abrasive Articles," Legacy et al., the entire disclosure of which is incorporated herein.

It is preferable that the woven scrim comprise at least 5 warp yams per inch and 5 fill yams per inch, and more preferably about 16 warp yams and fill yarns per inch. The preferred yams are at least 100 denier, and more preferably approximately 840 denier. A yarn may be one or more fibers that act as or are treated as one unit. A yam may be continuous filament or "spun" (aligned and twisted) from staple into a unified bundle. A yam may be multifilament (more than one continuous filament) or monofilament. The open area between the warp and weft fibers is preferably at least 5% of the total area of the scrim, and more preferable approximately 30%.

In one particularly preferred embodiment of surface treating article 210 illustrated in FIG. 7, the fastener 11 preferably has a 3 cm diameter base 27 and is injection molded from nylon 6,6 having up to 45% by weight reinforcing glass fibers. The scrim preferably includes sixteen warp yarns per inch and sixteen fill yams per inch. The yarns are preferably 840 denier multifilament nylon yams. The woven scrim preferably includes a PVC coating to maintain the weave. The non-woven web comprises nylon 6,6 staple fibers needle tacked to the woven scrim such that approximately 40% of the fibers extend through the interstices of the woven scrim. In addition, there are coatings of hard, thermosetting resins and abrasive particles applied to the front surface side 31 of the lofty nonwoven web. Resins, such as polyurethanes, may be exposed to the rear surface 234 of the surface conditioning article. After the article is cured, it is converted into individual surface conditioning discs.

The present invention has now been described with reference to several embodiments thereof. The foregoing detailed description has been given for clarity of understanding only. No unnecessary limitations are to be understood therefrom. It will be apparent to those skilled in the art that many changes can be made in the embodiments described without departing from the scope of the invention. For example, the fastener described herein may be used on any type of rotary tool, such as drill bits. Thus, the scope of the present invention should not be limited to the exact details and structures described herein, but rather by the structures described by the language of the claims, and the equivalents of those structures.

What is claimed is:

1. A surface treating article, comprising:

a) a surface treating element including a generally planer backing, said backing including a working surface and a rear surface, said working surface having desired characteristics for refining a surface; and b) a fastener located on said rear surface, said fastener including:

i) a first end opposite said backing;

ii) a second end adjacent said backing;

iii) a tapered portion, said tapered portion increasing in cross sectional area in the direction from said first end to said second end;

iv) a groove located between said tapered portion and said second end; and v) a mating portion having a non-circular cross section, wherein said mating portion includes walls and corners configured for close fit with an opening in a backup pad.

2. The surface treating article of claim 1, wherein said mating portion has a polygonal cross section.

3. The surface treating article of claim 2, wherein said mating portion has a regular polygonal cross section.

4. The surface treating article of claim 3, wherein said mating portion has a hexagonal cross section.

5. The surface treating article of claim 1, wherein said fastener has a cross-sectional area at said groove that is less than the largest cross-sectional area of the tapered portion.

6. The surface treating article of claim 5, wherein said fastener has a circular cross section at said groove.

7. The surface treating article of claim 6, wherein said fastener has a circular cross section at said tapered portion.

8. The surface treating article of claim 1, wherein said mating portion is between said groove and said second end of said fastener.

9. The surface treating article of claim 1, wherein said surface treating element comprises a molded brush including a plurality of bristles extending from said backing.

10. The surface treating article of claim 9, wherein said fastener is integrally molded with said molded brush.

11. The surface treating article of claim 1, wherein said surface treating element comprises a coated abrasive article having said fastener joined thereto.

12. The surface treating article of claim 1, wherein said surface treating element comprises a nonwoven surface conditioning article having said fastener joined thereto.

13. The surface treatment article of claim 1, wherein said mating portion of said fastener is tapered so as to be larger at said second end of said fastener.

14. A quick release system for releasably attaching a surface treating article to a backup pad, comprising:

a) a surface treating article, comprising a surface treating element including a generally planer backing, said backing including a working surface and a rear surface, said working surface having desired characteristics for refining a surface; and a fastener located in the center of said rear surface, said fastener including:

i) a first end opposite said backing;

ii) a second end adjacent said backing;

iii) a tapered portion, said tapered portion increasing in cross sectional area in the direction from said first end to said second end;

iv) a groove located between said tapered portion and said second end; and v) a mating portion having a non-circular cross section; and b) a backup pad including:

i) a body comprising a front surface and a back surface; and ii) a mounting opening provided on said front surface, said opening being formed by an inner surface generally perpendicular to said body and defining a non-circular cross section corresponding to said mating portion cross section, said opening including elastic means mounted therein for releasably engaging said groove in said fastener;

wherein said mating portion of said fastener is positioned in said mounting opening of said backup pad and wherein said elastic means in said backup pad opening is releasably engaged with said groove in said fastener.

15. The quick release system of claim 14, wherein said mating portion and said opening each have a polygonal cross section.

16. The quick release system of claim 15, wherein said mating portion and said opening each have a regular polygonal cross section.

17. The quick release system of claim 16, wherein said mating portion and said opening each have a hexagonal cross section.

18. The quick release system of claim 14, wherein said fastener has a cross-sectional area at said groove that is less than the largest cross-sectional area of the tapered portion.

19. The quick release system of claim 18, wherein said fastener has a circular cross section at said groove.

20. The quick release system of claim 19, wherein said fastener has a circular cross section at said tapered portion.

21. The quick release system of claim 14 wherein said mating portion is between said groove and said second end of said fastener.

22. The quick release system of claim 14, wherein said surface treating element comprises a molded brush including a plurality of bristles extending from said backing.

23. The quick release system of claim 14, wherein said fastener is integrally molded with said molded brush.

24. The quick release system of claim 23, wherein said surface treating element comprises a coated abrasive article having said fastener joined thereto.

25. The quick release system of claim 14, wherein said surface treating element comprises a nonwoven surface conditioning article having said fastener joined thereto.

26. A fastener for use with a rotary surface treating element, said fastener comprising a base including front surface and a rear surface and a fastener member extending from said rear surface; said fastener member including a first end opposite said base, a second end adjacent said base, a tapered portion, said tapered portion increasing in cross sectional area in the direction from said first end to said second end, a groove located between said tapered portion and said second end, and a mating portion having a non-circular cross section, wherein said mating portion includes walls and corners configured for close fit with an opening in a backup pad.

27. The fastener of claim 26, wherein said mating portion has a polygonal cross section.

28. The fastener of claim 27, wherein said mating portion has a regular polygonal cross section.

29. The fastener of claim 28, wherein said mating portion has a hexagonal cross section.

30. The fastener of claim 29, wherein said fastener member has a cross-sectional area at said groove that is less than the largest cross-sectional area of the tapered portion.

31. The fastener of claim 30, wherein said fastener member has a circular cross section at said groove.

32. The fastener of claim 31, wherein said fastener member has a circular cross section at said tapered portion.

33. The fastener of claim 32, wherein said mating portion is between said groove and said second end of said fastener member.

* * * * *

UNITED STATES PATENT AND TRADEMARK OFFICE

CERTIFICATE OF CORRECTION

PATENT NO. : 6,095,910
DATED : August 1, 2000
INVENTOR(S) : Luedeke, Arthur P.

It is certified that error appears in the above-identified patent and that said Letters Patent is hereby corrected as shown below:

Title page,
Item [56], U.S. PATENT DOCUMENTS, insert -- 4517863 5/1985 Ishikawa --; and "Baur" should read -- Bauer --; and delete "5,486,176" and insert -- 5,468,176 --; and delete "1/1996" and insert -- 11/1995 --.
FOREIGN PATENT DOCUMENTS, insert -- WO 9633638 10/1996 World Patent Office --; and insert -- WO 9633841 10/1996 World Patent Office --.

Column 2,
Line 5, "back up" should read -- back-up --.

Column 3,
Line 39, "comers" should read -- corners --.

Column 4,
Line 36, insert -- as -- following "such".

Column 9,
Line 32, insert -- herein by reference -- following "incorporated".

Column 11,
Line 9, "Trizac™" should read -- Trizact™ --.
Lines 38, 39, 40, 54 and 55, "yams" should read -- yarns --.
Lines 42 and 44, "yam" should read -- yarn --.

Signed and Sealed this

Twenty-seventh Day of May, 2003

JAMES E. ROGAN
*Director of the United States Patent and Trademark Office*